US005493965A

United States Patent [19]

Lizarazu

[11] Patent Number: 5,493,965

[45] Date of Patent: Feb. 27, 1996

[54] IMPACT ENGRAVING MACHINE

[76] Inventor: Pio E. Lizarazu, Barrio Carabel Txiqui s/n, 20120 Hernani (Guipuzcoa), Spain

[21] Appl. No.: 369,479

[22] Filed: Jan. 6, 1995

[30] Foreign Application Priority Data

Jun. 16, 1994 [ES] Spain ..... 940131

[51] Int. Cl.[6] ..... B31F 1/07

[52] U.S. Cl. ..... 101/3.1; 101/28

[58] Field of Search ..... 101/28, 3.1, 18, 101/19, 20, 29, 30

[56] References Cited

U.S. PATENT DOCUMENTS

| | | | |
|---|---|---|---|
| 1,990,592 | 2/1935 | Freeman | 101/3.1 |
| 2,262,180 | 11/1941 | Hauer . | |
| 2,348,566 | 5/1944 | Papazian | 101/3.1 |
| 2,381,921 | 8/1945 | Nord | 101/3.1 |
| 2,523,430 | 9/1950 | Hearn | 101/3.1 |
| 2,621,435 | 12/1952 | Weber | 101/3.1 |
| 2,621,842 | 12/1952 | Burdin | 101/3.1 |
| 3,339,279 | 9/1967 | Sovar et al. . | |
| 4,089,262 | 5/1978 | Sopora . | |
| 4,431,320 | 2/1984 | Alff et al. | 101/18 |
| 5,002,411 | 3/1991 | Therond . | |
| 5,368,400 | 11/1994 | Lyphert et al. | 101/28 |

FOREIGN PATENT DOCUMENTS

| | | |
|---|---|---|
| 371896 | 6/1990 | European Pat. Off. . |
| 2256833 | 8/1975 | France . |
| 2459086 | 1/1981 | France . |
| 2423424 | 11/1975 | Germany . |

*Primary Examiner*—Eugene H. Eickholt
*Attorney, Agent, or Firm*—Wigman, Cohen, Lettner & Myers

[57] ABSTRACT

An impact engraving machine. An impact engraving machine includes an engraving device (3) with striking point (4) which device is mounted on a support (5) movable in controlled manner along an axis (6) having a guide bar (7) of polygonal section and free turning. On this bar there is mounted a movable fixed bridge (10) and slide (9) which is related to the section of the belt (15) nearest to the bar (7). The assembly of guide-bar (7) and bridge (10) is related to a tipping mechanism (23).

5 Claims, 4 Drawing Sheets

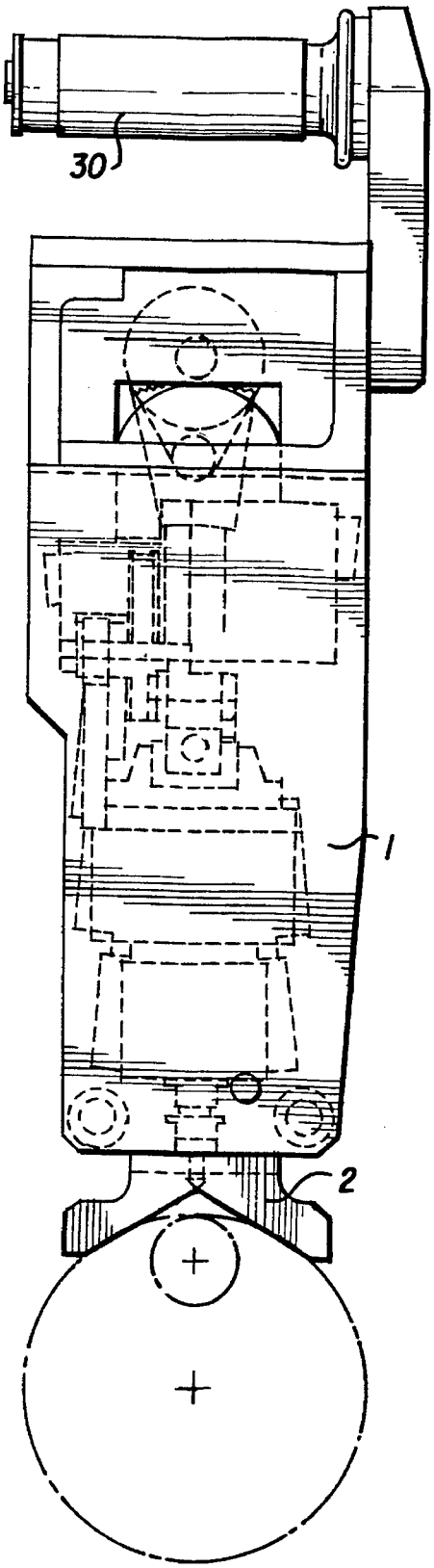
FIG. 2
FIG. 7
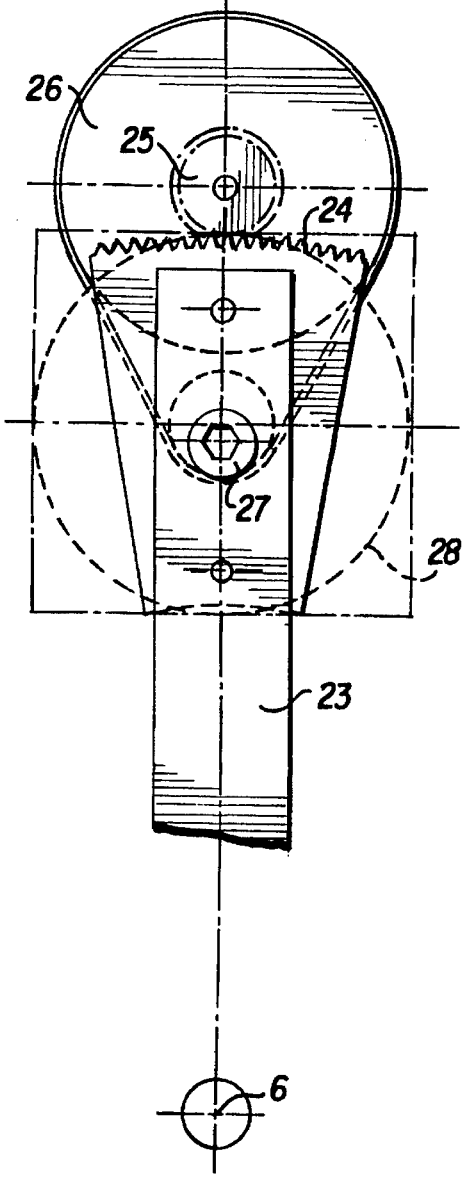

IMPACT ENGRAVING MACHINE

FIELD OF THE INVENTION

This invention is related to an impact engraving machine which includes a pneumatic or solenoid engraving device equipped with a striker point capable of impacting on the engraving surface and producing on the surface a pointed deformation on each impact.

BACKGROUND OF THE INVENTION

The machines of the type indicated are utilized to engrave signs and/or characters of different type on surfaces of pieces of metal, of plastic material, etc., the whole set of signs and characters engraved comprising a key or identification reference or a supplier of determined information.

Thus, for example, in the automobile industry nearly all of the parts utilized carry engraved reference numbers. It is necessary that the frame and motor of the vehicles carry an identifying number imprinted on them.

In order to carry out this engraving, it is necessary that the striker point, besides its axial placement originating from the engraving device, can be displaced according to two axes perpendicular to each other, parallel to the surface to be engraved. In order to meet these requirements machines are known which have two sides which displace each other in perpendicular directions, activated by the corresponding motors. Machines of this type have the drawback that they occupy a relatively large volume, due to the existence of the two movable slides.

For the purpose of reducing the volume of the machine, machines are known in which the engraving device is mounted on a support which can be moved in controlled manner along an axis parallel to the surface to be engraved and also can turn in both directions a certain angle, also in a controlled fashion, around said axis. This type of machine is usable when the surface to be engraved does not require an excessive turn of the striking point, in such a way that its incidence on the surface to be engraved is practically normal in all cases.

Machines of this type are described, for example, in German patent No. 24 23 424 and in European patent No. 371,896.

In German patent No. 24 23 424, the axis over which the support of the striking device is mounted is comprised of an endless screw which crosses a threaded bore hole of the support. This endless screw will cause the linear displacement of the support toward one side or the other. Also, on the lead screw there is mounted a U shaped stirrup, the central branch of which is related to the support and with the activating motor through the gear systems. The tipping of the stirrup causes the turning one way or the other of the support, around the lead screw.

This configuration involves a considerable complication of the activating mechanisms, due partly to the arrangement of the two activating motors on the chassis of the machine. However, the turn of the support around the endless screw provokes a certain linear displacement thereof, even though of minimal magnitude, which acts to the detriment of precision in the engraving operation.

In the European patent No. 371,896, the axis on which the support of the engraving device is mounted consists of a bar of circular section, along which the support can be moved and on which it can turn a certain angle in both directions.

As in the previous case, when the two activating motors located on the chassis of the machine operate, transmission mechanisms are required from the two motors for the linear displacement and for the turn of the support, complicating the construction and function of the whole.

In the two cases commented upon, the support of the engraving device is revolving with respect to the lead screw or bar along which the linear displacement of the device takes place.

SUMMARY OF THE INVENTION

This invention has the purpose of a machine of the type stated, in which the support of the engraving device can rotate and be linearly displaced in controlled fashion on an axis, both with some systems of activation which enable simplifying the transmission mechanism and achieving a high precision in the engraving operation. Also in a machine in accordance with the invention, the support of the engraving device is not revolving with respect to the part which makes up the axis along which the linear displacement of the support will take place.

According to this invention, the axis along which the support of the pneumatic device can be moved is comprised of a guide-bar of polygonal section, which can turn freely on its axis. This guide-bar carries a mounted slide which can move freely along it, and a fixed bridge which runs between the ends of the bar. The bridge in turn has mounted on its outside a longitudinal transmission mechanism, comprised of a belt which runs along the bridge, in parallel direction to the guide-bar, and an activating end motor. The carrier support of the engraving device is set on the slide, directed in a contrary direction to the one occupied by the bridge, and it is related to the section of the belt nearest the guide-bar.

The system formed by the guide-bar and bridge is related to a tipping mechanism mounted on the frame of the machine. This tipping mechanism is comprised of an arm which is set perpendicularly by one of the ends to the system formed by the guide-bar and the bridge, while on the opposite end it is capped in a toothed sector, with an axis of turn coinciding with that of the guide-bar, which meshes with a pinion activated by the motor. The pinion and motor are mounted on the machine's frame. The support of the engraving device has an arm which overhangs the one occupied by the striking point in the opposite direction, behind the bridge. This arm is crossed perpendicularly with the section of the belt nearest the guide-bar and it has, on the front surface, a transverse slot which can be coupled on the said section of belt, without possibility of slipping relative to each other.

BRIEF DESCRIPTION OF THE DRAWINGS

For a full understanding of the nature and objectives of the invention, reference should be made to the following detailed description taken in conjunction with the accompanying drawings in which:

FIG. 2 is a left side elevation of the machine in FIG. 1.

FIG. 7 is a partial section according to the section line VII—VII of FIG. 1.

DETAILED DESCRIPTION OF THE INVENTION

Figure 5:
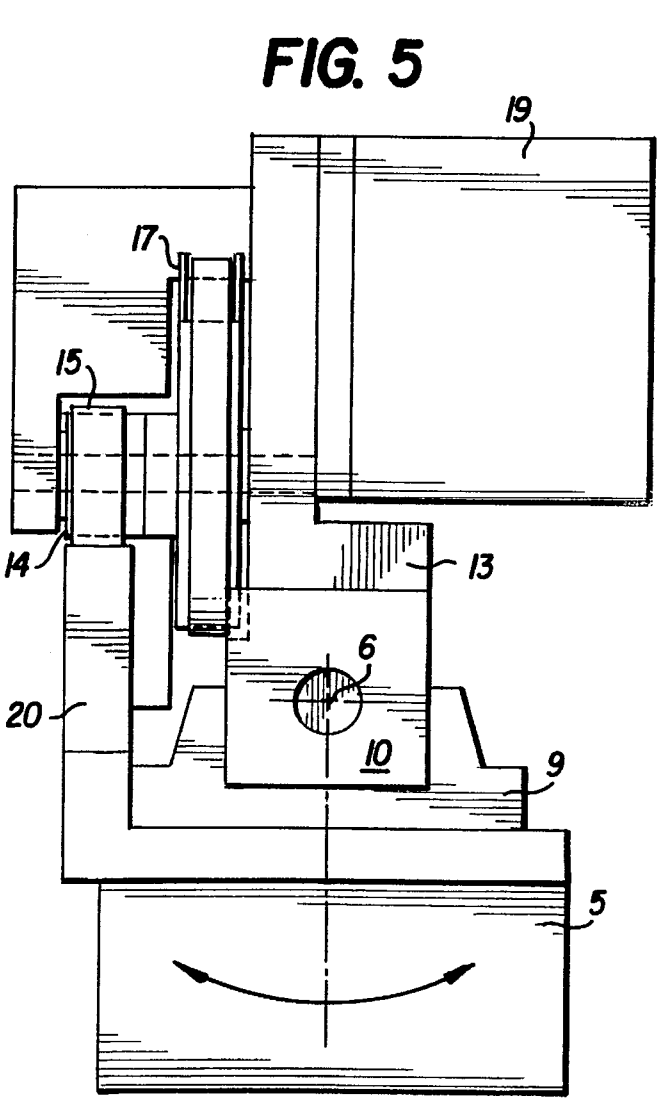
FIG. 5 is a side elevation of the guide-bar and bridge assembly, according to direction A of FIG. 4.

Referring now to the figures wherein like elements are designated by like reference numerals, and as can be observed in FIGS. 1 to 3, the machine according to the invention includes a frame or structure 1 which is capped below on lugs 2 of angular support, which enables locating the machine both on flat surfaces and on curved surfaces, for their engraving.

The machine includes an engraving device 3 which is equipped with a striking point 4, which impacts on the surface to be engraved in order to produce point deformities on it with each impact. The device 3 is mounted on a support 5 which can be moved in controlled manner along an axis 6, parallel to the surface to be engraved, and it can also turn in both directions a certain angle, also in controlled manner, around the axis 6.

Figure 6:
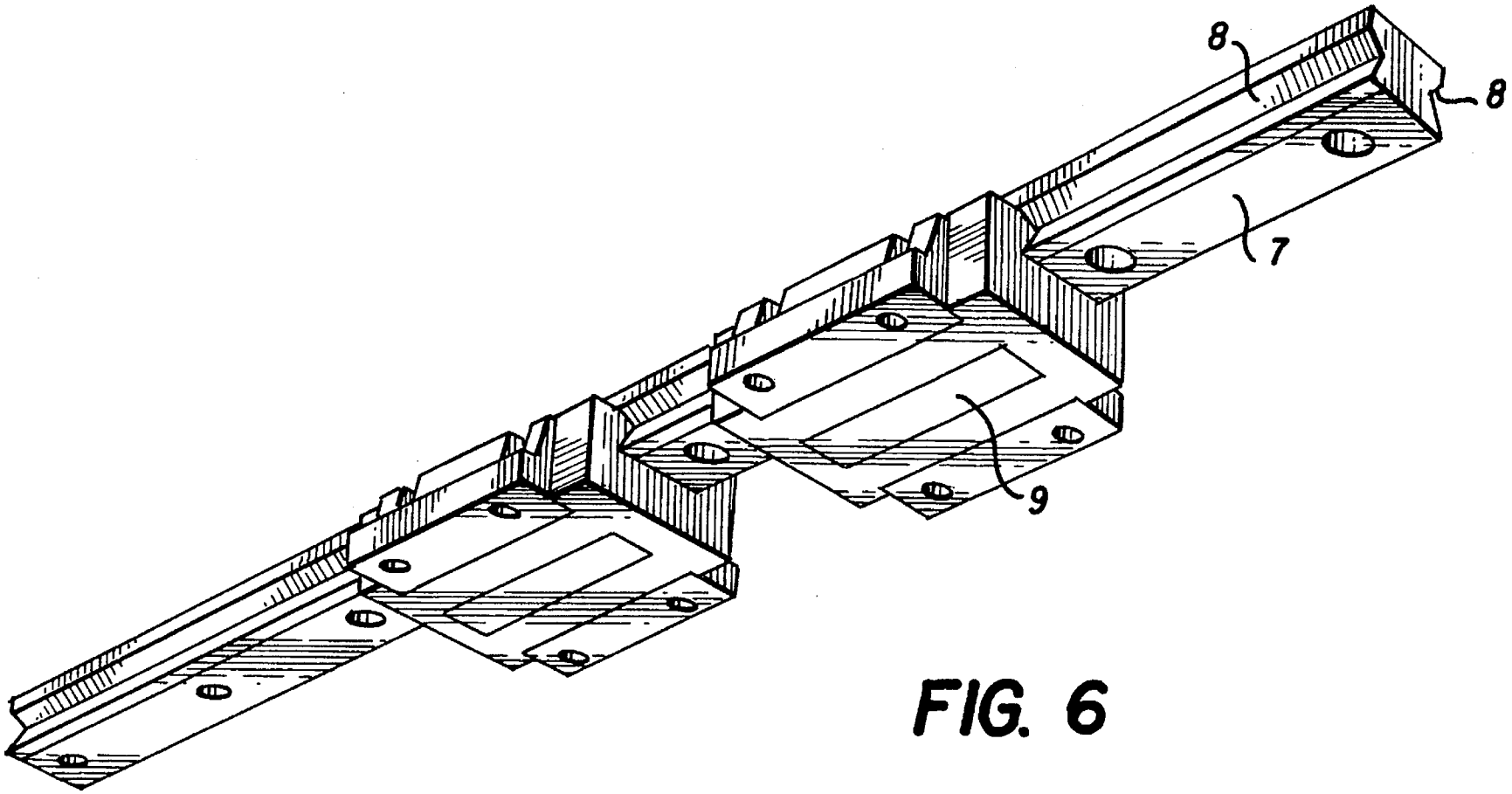
FIG. 6 shows in perspective the guide-bar with the movable slide mounted on it.

In the machine according to the invention, the axis 6 is embodied in a guide-bar 7, FIG. 6, of polygonal section, which can adopt for example a section approximately rectangular, having angular longitudinal channels 8 coming from two of its opposing faces. In this guide-bar, a slide 9 is mounted which partially covers the bar between the channels 8. The slide 9 is the bearer of race elements which will facilitate their sliding along the bar 7.

Figure 1:
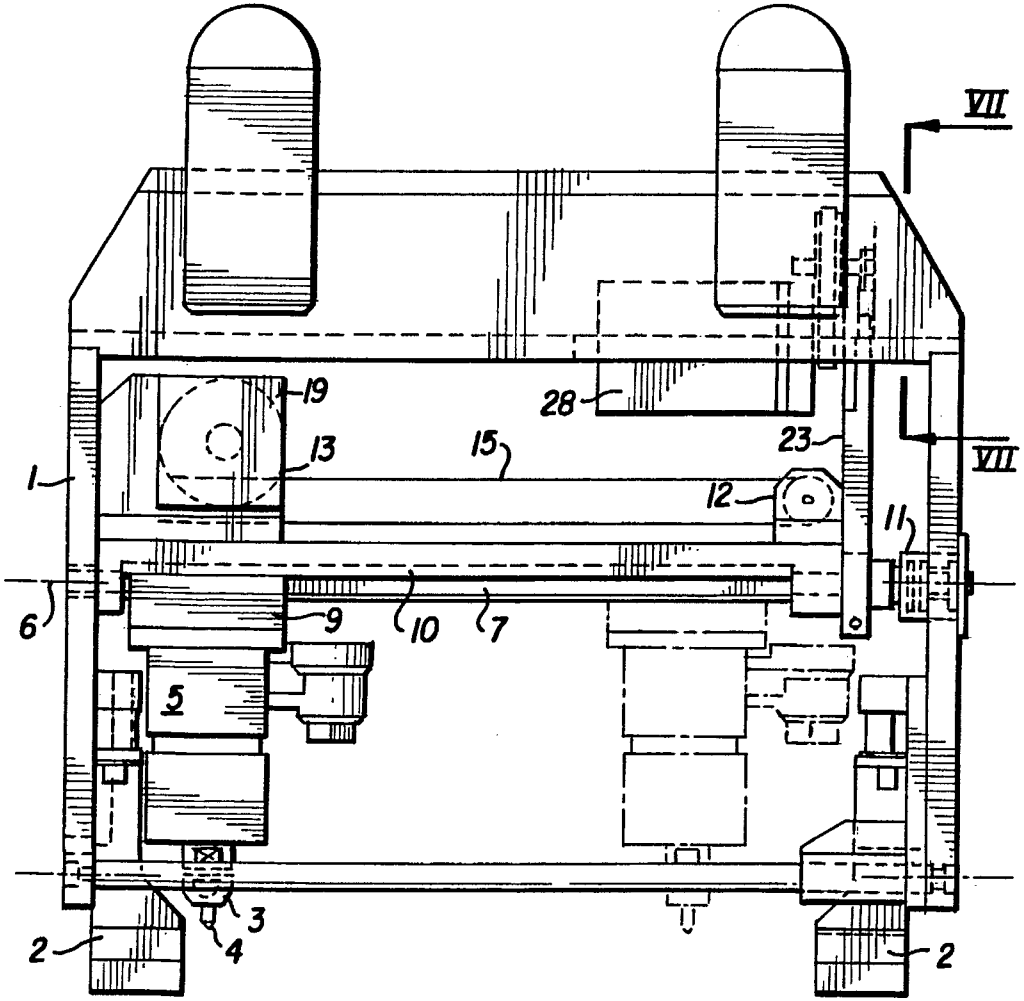
FIG. 1 is a front elevation of an impact engraving machine in accordance with the invention.
Figure 4:
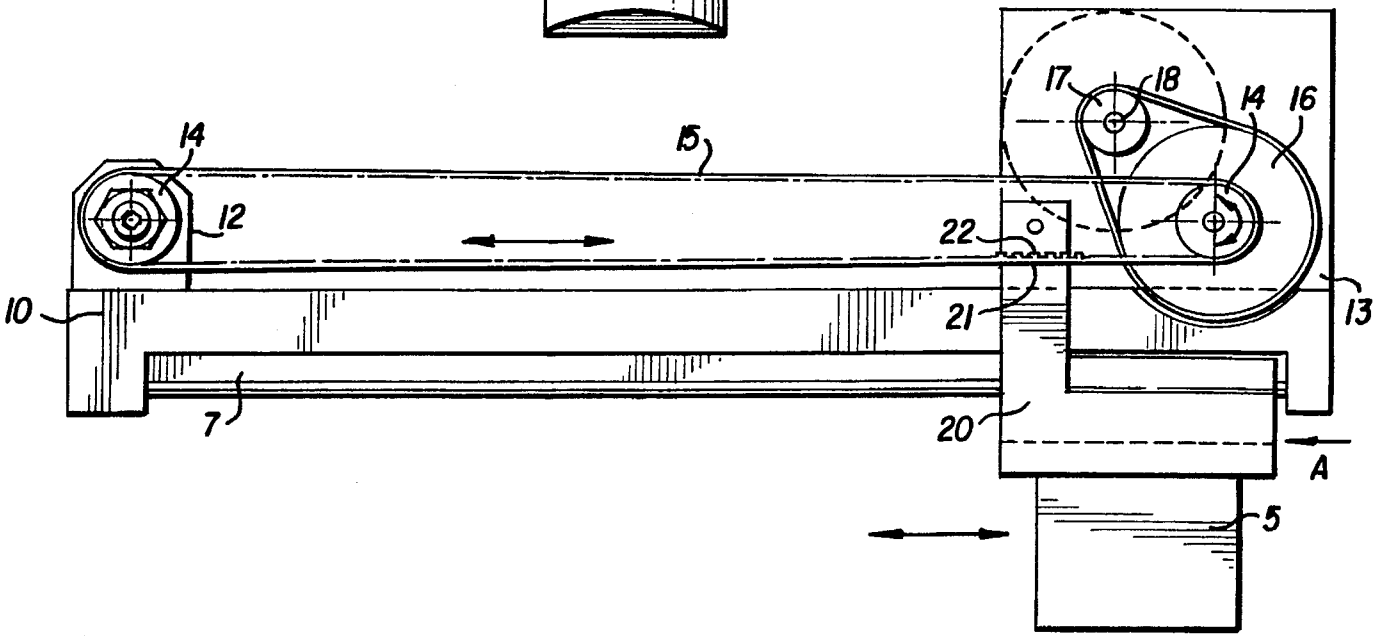
FIG. 4 is a rear elevation of the system formed by the guide-bar and bridge, including the support of the engraving device and the linear displacement mechanism of the same.

The guide-bar 7 also has mounted between its ends a fixed bridge 10, FIGS. 1, 4 and 5. As observed in FIG. 1, the system formed by the guide-bar 7 and the bridge 10 is mounted with the possibility of free turning between the laterals of the frame or chassis 1 of the machine, by means of bearings 11.

As can be observed in FIGS. 4 and 5, the bridge 10 has fastened on the outside two end supports 12 and 13, which are carriers of pulleys 14 between which a belt 15 runs. On the axis of the pulley 14 a pulley 16 of greater diameter is mounted which is related by means of a transmission belt to the pulley 17 of smaller diameter which is solidary with the axis 18 of an activating motor 19.

The support 5 of the engraving device 3 has an arm 20, FIGS. 4 and 5, which overhangs in the direction opposite to that occupied by the striking point 4, FIG. 1, behind the bridge 10 and comes to cross perpendicularly the stretch of the belt 15 nearest to the guide-bar 7. This arm has, coming from its front surface, a transverse slot 21, FIG. 4, in which this lower section of the belt is introduced as adjusted, without possibility of their slipping from each other. Preferably the belt 15 will have an internal surface transversely ribbed and the slot 21 will be limited, at least on one of its surfaces, by a gearing 22 capable of being coupled between the ribbing of the belt 15, in order to assure mutual anchorage.

With this construction, the displacement of the belt 15 is caused by means of the motor 19, which will drag the arm 10 along the guide-bar 7, varying the direction of turn of the motor the change of direction of displacement of the support 5 is achieved and, thereby, the direction of displacement of the engraving device 3.

The motor 19 utilized for causing the displacement of the slide 7 and thereby the engraving device 3, is mounted on the bridge 10 set at the ends of the guide-bar 7.

As is observed in FIG. 1, the system formed by the guide-bar 7 and the bridge 10 is related to the tipping mechanism which is comprised of an arm 23 which is fastened perpendicularly at one of its ends to the said system, as a continuation of the bridge 10. The opposite end this arm 23 is capped in a toothed sector 24, FIG. 7, on an axis coinciding with the axis of turn 6 of the guide-bar 7. The toothed sector 24 engages with a pinion 25 with which a pulley 26 of greater diameter is solidary, which is related to a smaller pulley 27, solidary with the axis of an activating motor 28 which is mounted on the chassis 1 of the machine.

Activation of the motor 28, FIG. 7, will cause the rotation of the pinion 25 in the desired direction and magnitude. When this pinion engages with the rack 24 it will cause the tipping of the arm 23 and thereby the turn of the system formed by the guide bar 7 and bridge 10. This turn will translate into an angular displacement of the engraving device 3 and striking point 4, this angular displacement being of sufficient breadth so that the striking point 4 reaches the limits of the surface to be engraved without producing alterations in the characteristics of quality of the print produced by each impact.

In the machine described above, the linear displacement of the support 5 and therefore of the engraving device 3 is achieved by means of a transmission mechanism 15 and an activating motor 19 which are mounted on the bridge 10 solidary with the guide-bar 7, while the motor 28 and transmission mechanism which causes the tipping of the engraving device 3 is mounted on the chassis 1 of the machine. In this way one achieves the simplification of the transmission mechanism and obtains a maximum exactitude and safety both in the linear displacement movement and in its tipping movement.

The system of fastening of the support 5 to the transmission belt 15 is simple and of great safety. The motor 28, in turn, which will produce the tipping of the engraving device 3 is mounted on the structure of the machine and the transmission mechanism between said motor and the guide-bar 7 is comprised of a system of gears which makes it possible to achieve the maximum precision in the angle of tipping of the striking point 4.

Figure 3:
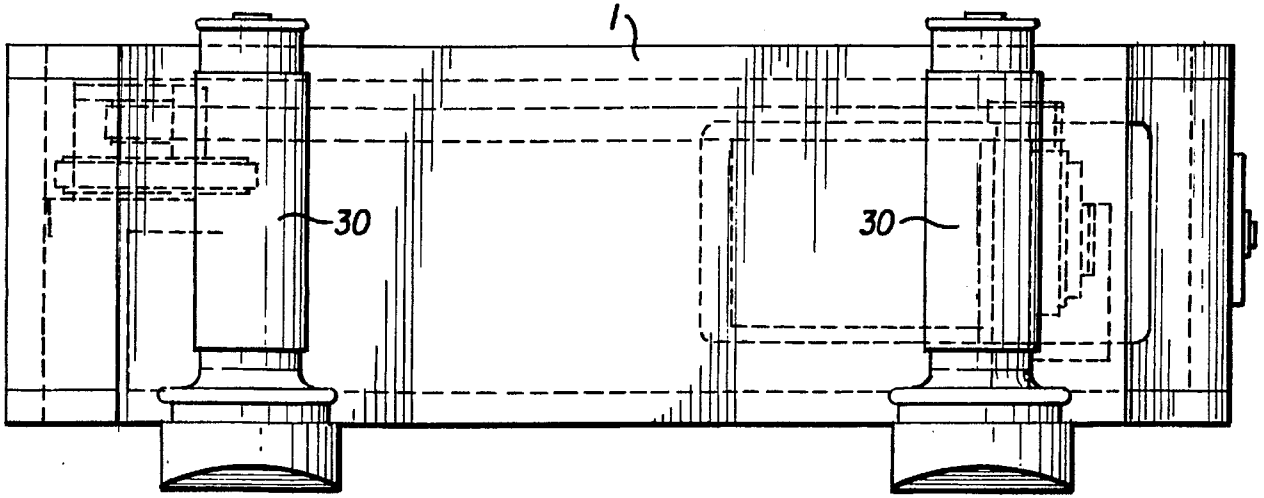
FIG. 3 is a top view of the machine represented in FIG. 1.

As is observed in FIGS. 1 to 3, the machine can be equipped with upper handles 30 which facilitate its manipulation in the portable version.

The system permits marking on two planes located up to 90° apart, only by increasing the arc of turn by means of the parts 24, FIG. 7.

Although a certain presently preferred embodiment of the present invention has been specifically described herein, it will be apparent to those skilled in the art to which the invention pertains that variations and modifications of the embodiment shown and described herein may be made without departing from the spirit and scope of the invention. Accordingly, it is intended that the invention be limited only to the extent required by the appended claims and the applicable rules of law.

What is claimed is:

1. An impact engraving machine comprising a pneumatic or solenoid engraving device equipped with a striking point capable of impacting on the surface to be engraved and producing on it a point deformity on each impact, which device is mounted on a support which can be moved in controlled manner along an axis parallel to the surface to be engraved, and may turn through an angle in both directions, also in controlled manner, around said axis, wherein said axis is embodied in a guide-bar of polygonal section, freely moved along said guide-bar, and a fixed bridge which runs between the ends of the guide bar; said bridge bearing mounted on the outside a longitudinal transmission mechanism comprised of a belt which runs along the bridge, and an activating end motor, while the support bearing the engraving device is fastened to a slide, directed in opposite direction to that occupied by the bridge and it is related with the section of the belt nearest to the guide-bar and a frame supporting an assembly formed by said guide-bar and bridge and mounting a tipping mechanism

2. A machine according to claim 1, wherein the machine includes a frame and wherein further the tipping mechanism is comprised of an arm which is set perpendicularly at one of its ends to the assembly formed by the guide-bar and the bridge, while on the opposite end it is capped to a toothed sector with turning axis coinciding with that of the guide-bar which engages with a pinion activated by a motor, the pinion and motor being mounted on the frame of the machine.

3. A machine according to claim 1 wherein the guide-bar is of an approximately rectangular section and shows on two of its opposed faces longitudinal angular channels, partially covering the slide and the said bar between the channels mentioned, with interposition of bearing elements which facilitate the sliding of the slide.

4. A machine according to claim 1 wherein the bridge mounts carriers of fixed pulleys fastened off outside two end supports of said bridge between which pulleys runs the longitudinal transmission mechanism, one of these fixed pulleys carrying a second coaxial pulley (16) of greater diameter which remains related by means of the transmission belt with a pulley of smaller diameter set on the axis of exit of the activating motor, which motor is mounted on one of the outside supports.

5. A machine according to claim 1 wherein the support of the engraving device has an arm which overhangs in the opposite direction that occupied by the striking point behind the bridge, which arm perpendicularly crosses with the section of the belt nearest to the guide-bar and has, coming from the front surface, a transverse slot which is coupled as adjusted on said section of the belt, without possibility of slipping from each other.

* * * * *